US007374442B2

(12) United States Patent
Anzai et al.

(10) Patent No.: US 7,374,442 B2
(45) Date of Patent: May 20, 2008

(54) MEMORY CARD SOCKET STRUCTURE

(75) Inventors: Tsunehiro Anzai, Watarai (JP); Hirohisa Tanaka, Tsu (JP); Nobuhiko Kimura, Suzuka (JP); Toshiya Kimura, Tsu (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 11/512,219

(22) Filed: Aug. 30, 2006

(65) Prior Publication Data

US 2007/0049081 A1 Mar. 1, 2007

(30) Foreign Application Priority Data

Aug. 30, 2005 (JP) ..... 2005-249825

(51) Int. Cl.
*H01R 29/00* (2006.01)

(52) U.S. Cl. ..... 439/188; 439/630

(58) Field of Classification Search ..... 439/188, 439/630

See application file for complete search history.

(56) References Cited

U.S. PATENT DOCUMENTS 4,894,019 A 1/1990 Howard ..... 439/188
5,395,259 A 3/1995 Casses ..... 439/188
5,507,665 A 4/1996 Oda ..... 439/489
6,425,775 B1 7/2002 Chang et al. ..... 439/188
6,890,198 B2 * 5/2005 Kawahata et al. ..... 439/188

FOREIGN PATENT DOCUMENTS

JP 2004-319273 11/2004
JP 2005-134978 5/2005

* cited by examiner

*Primary Examiner*—Javaid H. Nasri
(74) *Attorney, Agent, or Firm*—Bacon & Thomas, PLLC

(57) ABSTRACT

A memory card socket structure includes an arm rotatably moved by an insertion and an extraction of a memory card into and from a card compartment and a memory card detecting function for detecting whether the memory card is inserted into the card compartment. The arm includes a main portion to be in contact with the memory card and a sub portion disposed opposite to the main portion with respect to a rotation shaft thereof, and is located at a rear side of the card compartment. The arm is engaged with a torsion spring whose first end portion is engaged with a first stationary contact but whose second end portion is engaged with the sub portion, whereby the main portion is biased by the spring toward an entrance of the card compartment.

9 Claims, 10 Drawing Sheets

MEMORY CARD SOCKET STRUCTURE

FIELD OF THE INVENTION

The present invention relates to a memory card socket structure for accommodating a memory card used as a small card-shaped storage medium.

BACKGROUND OF THE INVENTION

Recently, various electronic devices such as a digital camera and a mobile phone have been increasingly equipped with a memory card socket structure for allowing a small-sized storage medium (hereinafter, simply referred to as a 'memory card') such as a Mini SD Memory Card (Registered Trademark) to be inserted thereinto or taken out therefrom.

As one type of such conventional memory card socket structures, there has been proposed one equipped with a memory card detecting mechanism for detecting whether a memory card is inserted or not (see, for example, Japanese Patent Laid-open Application No. 2004-349223: Reference 1).

The memory card socket structure disclosed in Reference 1 has a movable spring piece which is configured to be in pressurized contact with a stationary contact as a memory card is inserted into the socket structure. As a result of the movable spring piece being connected with or disconnected from the stationary contact, a circuit is opened or closed, whereby the presence or absence of the memory card in the socket structure is detected electrically. The movable spring piece is configured so as to be moved along a width-wise direction of the memory card while coming into contact with a lateral side (width-wise end surface) of the memory card.

In this way, when a memory card is in a size similar to the Mini SD Memory card, it is relatively easy to configure a movable spring piece to provide an enough biasing force (contact separation force) to play its intended role. However, in case of a memory card socket structure adapted for smaller memory cards, the movable spring piece is required to be reduced in size, which in turn, causes difficulty of exerting a sufficient biasing force with such movable spring pieces.

Further, in the configuration where the movable spring piece is moved along the width-wise direction of the memory card, as illustrated in Reference 1, a stroke of the movable spring piece needs to be set greater than a force required for a dimensional tolerance of the memory card in its width-wise direction. However, as for a memory card socket structure adapted for a memory card of a smaller size, the size of a movable spring piece employed therein should be smaller as well, thereby causing a difficulty of setting the stroke to be greater than the force required for the dimensional tolerance.

SUMMARY OF THE INVENTION

It is, therefore, an object of the present invention to provide a memory card socket structure having a memory card detecting mechanism capable of detecting an insertion of a small memory card in a surer manner.

In accordance with a preferred embodiment of the present invention, there is provided a memory card socket structure including: a case having a card accommodating portion for receiving a thin plate-shaped memory card; a contact block having contact terminals for the connection with electrodes of the memory card; and a movable arm rotatably installed at the contact block and moved in combination with an insertion and an extraction of the memory card into and from the card accommodating portion, wherein the memory card socket structure has a memory card detecting function for detecting whether the memory card is inserted into the card accommodating portion by way of switching an opening/closing of a circuit depending on the movement of the movable arm, wherein the movable arm includes a main arm portion to be in contact with the memory card and a sub arm portion disposed opposite to the main arm portion with respect to a rotation shaft, and the movable arm is supported at an inner wall of the contact block such that the main arm portion is rotated between a position where the movable arm is fully rotated toward an entrance side of the card accommodating portion and an mounted position near a rear side of the card accommodating portion, wherein the rotation shaft of the movable arm is wounded with a torsion spring formed of a conductive material, and a first end portion of the torsion spring is engaged with a first stationary contact provided at the contact block, while a second end portion thereof is engaged with a sub arm portion, whereby the main arm portion of the movable arm is rotatingly biased by the torsion spring toward the entrance side, and wherein as the second end portion of the torsion spring is rotated along with the sub arm portion to be connected or disconnected with a second stationary contact provided at the contact block, the opening/closing of the circuit including the first stationary contact, the torsion spring and the second stationary contact is switched.

In the above configuration, by using the torsion spring, a greater pressing force can be applied to the movable arm and also the memory card, while the space occupied by the torsion spring is kept relatively small.

BRIEF DESCRIPTION OF THE DRAWINGS

The above and other objects and features of the present invention will become apparent from the following description of preferred embodiments given in conjunction with the accompanying drawings, in which:

FIGS. 7A to 7D illustrate a movable arm of the memory card detecting mechanism of the memory card socket structure, in which FIG. 7A is a top view of the movable arm viewed from the cover shell side; FIG. 7B is a side view of the movable arm viewed from an opening side of a card accommodating portion; FIG. 7C is a bottom view of the movable arm viewed from a base shell side; and FIG. 7D is a view of the movable arm viewed from a width-wise direction of the card accommodating portion;

FIGS. 8A and 8B show top views of major components of the memory card detecting mechanism, in which FIG. 8A illustrates the movable arm located at an entrance-side position of the socket structure; and FIG. 8B illustrates the movable arm held in a mounted position thereof;

DETAILED DESCRIPTION OF THE PREFERRED EMBODIMENTS

Figure 1:
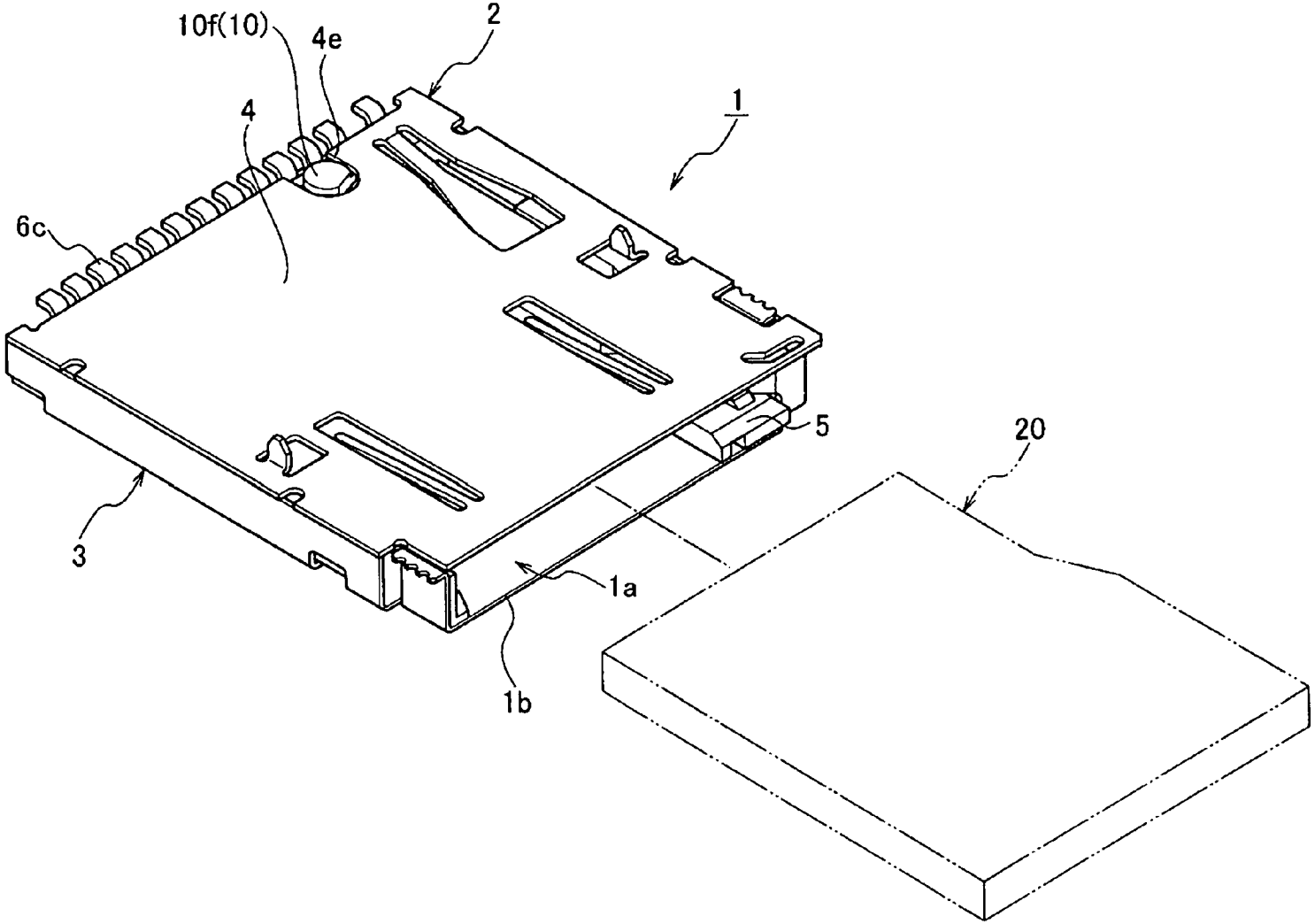
FIG. 1 is a perspective view of a memory card socket structure in accordance with a preferred embodiment of the present invention before an insertion of a memory card thereinto.
Figure 2:
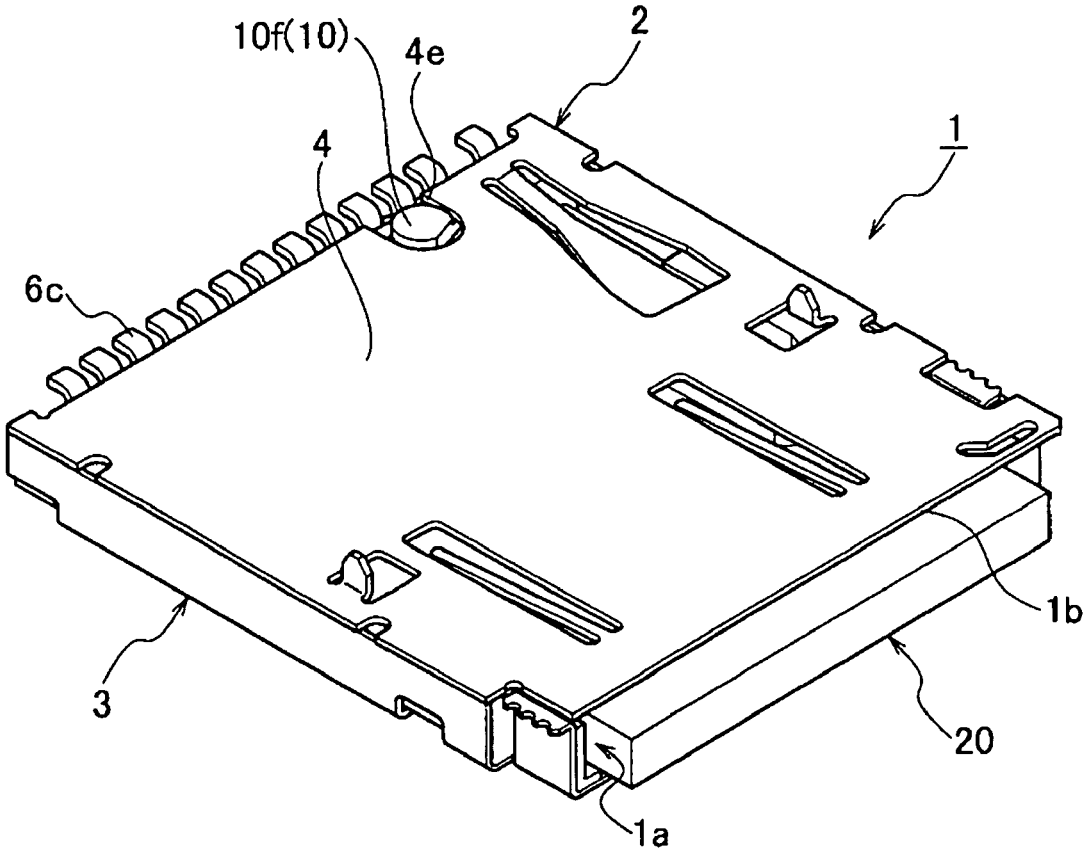
FIG. 2 sets forth a perspective view showing a state where the memory card is inserted in the memory card socket structure in accordance with the preferred embodiment of the present invention.
Figure 3:
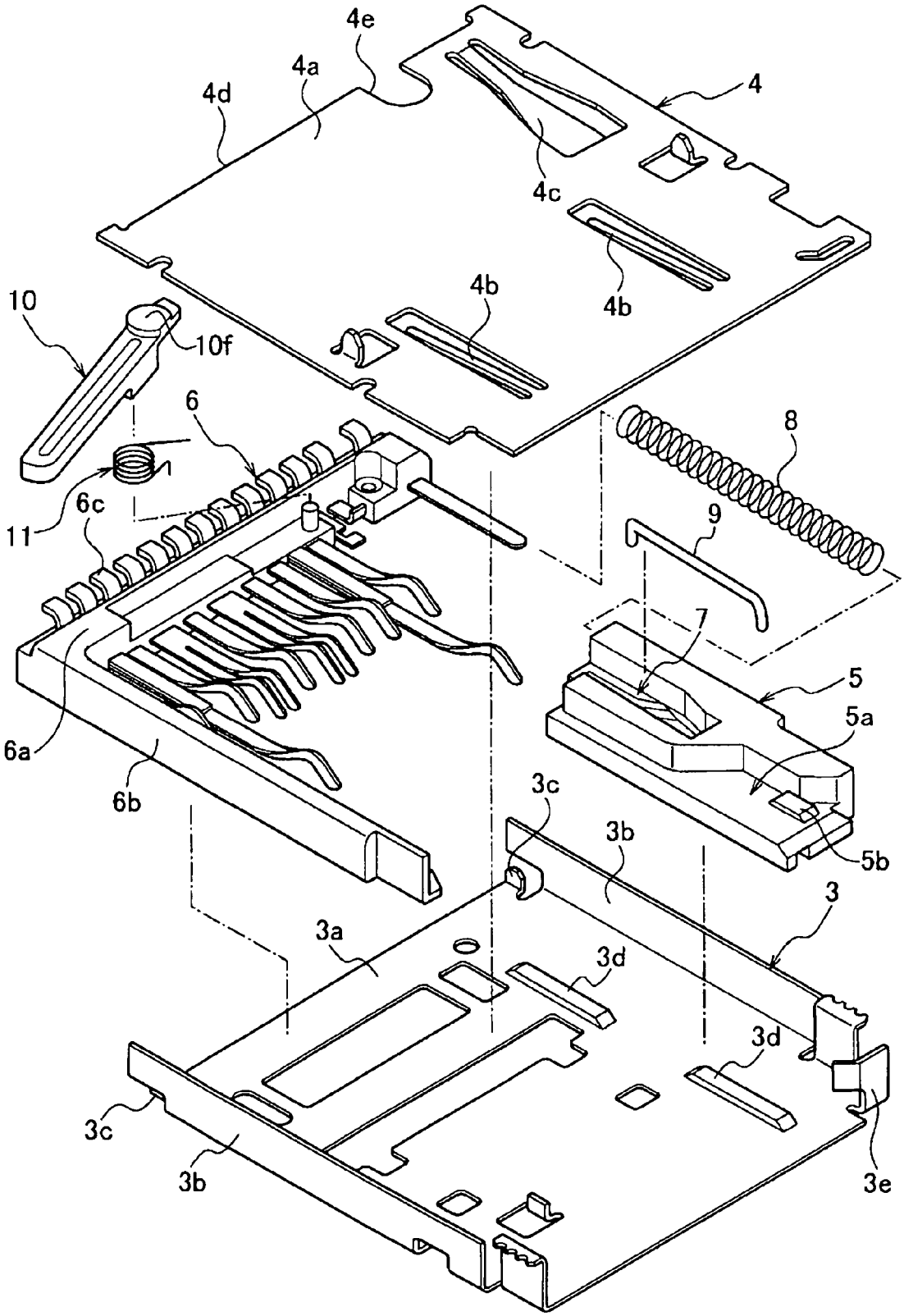
FIG. 3 presents an exploded perspective view of the memory card socket structure.

Hereinafter, preferred embodiments of the present invention will be descried in detail with reference to the accompanying drawings.

A memory card socket structure 1 in accordance with a preferred embodiment of the present invention is disposed at an electronic device (not shown) or the like to serve as a socket for allowing a memory card 20 to be inserted thereinto or taken out therefrom. When the memory card 20 is inserted into the memory card socket structure 1, electrodes (not shown) formed and exposed at a front or a rear surface of the memory card 20 is brought into contact with contact terminals 6*c* provided in the memory card socket structure 1, i.e., electrically connected, thus making it possible to tranceive data between the electronic device or the like and the memory card 20.

Further, the memory card socket structure 1 is configured to have a so-called push-on and push-off mechanism, in that the memory card 20 can be locked in a preset mounting state by being inserted and pushed into a card compartment 1*a* of the memory card socket structure 1 through an opening (entrance) 1*b* thereof, and can be unlocked from the locked state and rejected from the opening 1*b* of the card compartment 1*a* by being pushed thereafter.

In general, the memory card socket structure 1 includes a case 2 having a rectangular shelled shape with a substantially plan surfaces and the thin elongated strip-shaped opening 1*b* at its one side (front side); a slider 5 supported in the card compartment 1*a* of the case 2 so as to be moved back and forth between the opening 1*b* side and the rear side of the card compartment 1*a*; a coil spring 8 serving as a basing mechanism for urging the slider 5 toward the opening 1*b* side in the card compartment 1*a*; and a contact block 6 disposed at the rear portion of the card compartment 1*a*.

The case 2 is an assembly of a base shell 3 and a cover shell 4, each of which is formed by appropriately shaping a thin metal plate such as stainless steel having an electric conductivity and featuring a high thermal conductivity.

The base shell 3 includes a substantially rectangular base 3*a* and two sidewalls 3*b* of a certain height formed by bending a pair of opposite end sides of the base 3*a* approximately in perpendicular manners. Further, a stopper 3*e* is formed at an opening 1*b* side of one of the sidewalls 3*b* such that the stopper 3*e* is projected toward an inner side of the base shell 3 in a width-wise direction thereof. With the stopper 3*e*, the slider 5 is prevented from releasing out of the opening 1*b*. Further, the base 3*a* has hook portion 3*c* on which the contact block 6 is hooked to be fastened in its installation position; projection bars 3*d* elongated in a reciprocating direction of the memory card 20 to guide the slider 5; and so forth.

The cover shell 4 is obtained by forming a plate-shaped member into an approximately rectangular shape. The cover shell 4 has a base 4*a* provided with spring members 4*b* punched at plural locations of the base 4*a* appropriately to press the memory card 20 with a relatively light force, and the base 4*a* also has a spring structure 4*c* for pressing a pin 9 to be described later with a relatively light force.

The base shell 3 and the cover shell 4 are coupled to form a substantially rectangular shelled shape by, e.g., laser welding, and one opening of the rectangular shelled structure is closed with the contact block 6, so that the card compartment 1*a* is formed inside the case 2 to have a substantially rectangular shelled shape having an evenly leveled bottom. The memory card 20 is accommodated in the card compartment 1*a*. That is, in this preferred embodiment, the card compartment 1*a* serves as a card accommodating portion.

The slider 5 has recesses (not shown) configured to correspond to the projection bars 3*d* provided on the base shell 3. Further, by engaging the projection bars 3*d* with the recesses, the slider 5 is guided to move back and forth along one of lateral edges of the card compartment 1*a* (i.e., one of the sidewalls 3*b* of the base shell 3). Further, the slider 5 has a recess portion 5*a* to be fitted with a corresponding shape provided on a peripheral surface of one side of the memory card 20, and it also has a protrusion 5*b* to be engaged with a cutoff portion 20*a* of the memory card 20. If the memory card 20 is inserted into the card compartment 1*a* in a preset posture, the memory card 20 is configured to engage the cutoff portion 20*a* with the protrusion 5*b* of the slider 5 while coming into contact with the recess portion 5*a*, whereby the memory card 20 is allowed to be moved back and forth in the card compartment 1*a* while being maintained on the slider 5.

The position of the slider 5 in the card compartment 1*a* is controlled by the pin 9 whose first end is rotatably fixed at the contact block 6, a groove portion 7 for guiding a second end of the pin 9 along a preset path, and the coil spring 8, interposed between the slider 5 and the contact block 6, for biasing the slider 5 toward the opening 1*b* side. Specifically, under the condition of forming predetermined steps on the bottom surface of the groove portion 7, the pin 9's second end proximal to the opening 1*b* side is guided into a desired passage of the groove portion 7 not only by a biasing force of the coil spring 8 and a force of insetting the memory card 20 but also by being biased against the bottom portion of the groove portion 7 from the spring structure 4*c* provided at the cover shell 4. Further, the groove portion 7's part closed to the opening 1*b* side can be adapted to be in a substantially heart shape when viewed from the top, forming a so-called heart cam mechanism. Therefore, the above-mentioned push-on and push-off functions of the memory card 20 can be realized.

The contact block 6 has an inner wall 6*a* and a sidewall 6*b* made of an insulating resin, wherein the inner wall 6*a* and the sidewall 6*b* together form an L-shape when viewed from the top. The contact block 6 is fixed on the base shell 3 such that its inner wall 6*a* is disposed at the rear side of the card compartment 1*a*, while its sidewall 6*b* is disposed at a remaining one of lateral edges of the card compartment 1*a* (i.e., an edge where the slider 5 is not installed). Further, the hook portion 3*c* provided at the base shell 3 is used for fixation of the contact block 6.

The inner wall 6*a* has a plurality of bar-shaped contact terminals 6*c* penetrating it, wherein the contact terminals 6*c* are formed of a conductive metal. The contact terminals 6*c* contact the electrodes (not shown) formed on the surface of the memory card 20 when the memory card 20 is mounted on a preset position in the rear side of the card compartment 1*a*. By the contact terminals 6*c*, various data can be transferred between an electronic device (not shown) equipped with the memory card socket structure 1 and the memory card 20. Here, some of the contact terminals 6*c* are set to be used for, for example, the detection of the memory card 20, rather than contacting the electrodes of the memory card 20. Further, the contact terminals 6*c* can be fixed to the inner wall 6*a* by molded inserts or by being inserted through small holes bored through the inner wall 6*a*.

Figure 4:
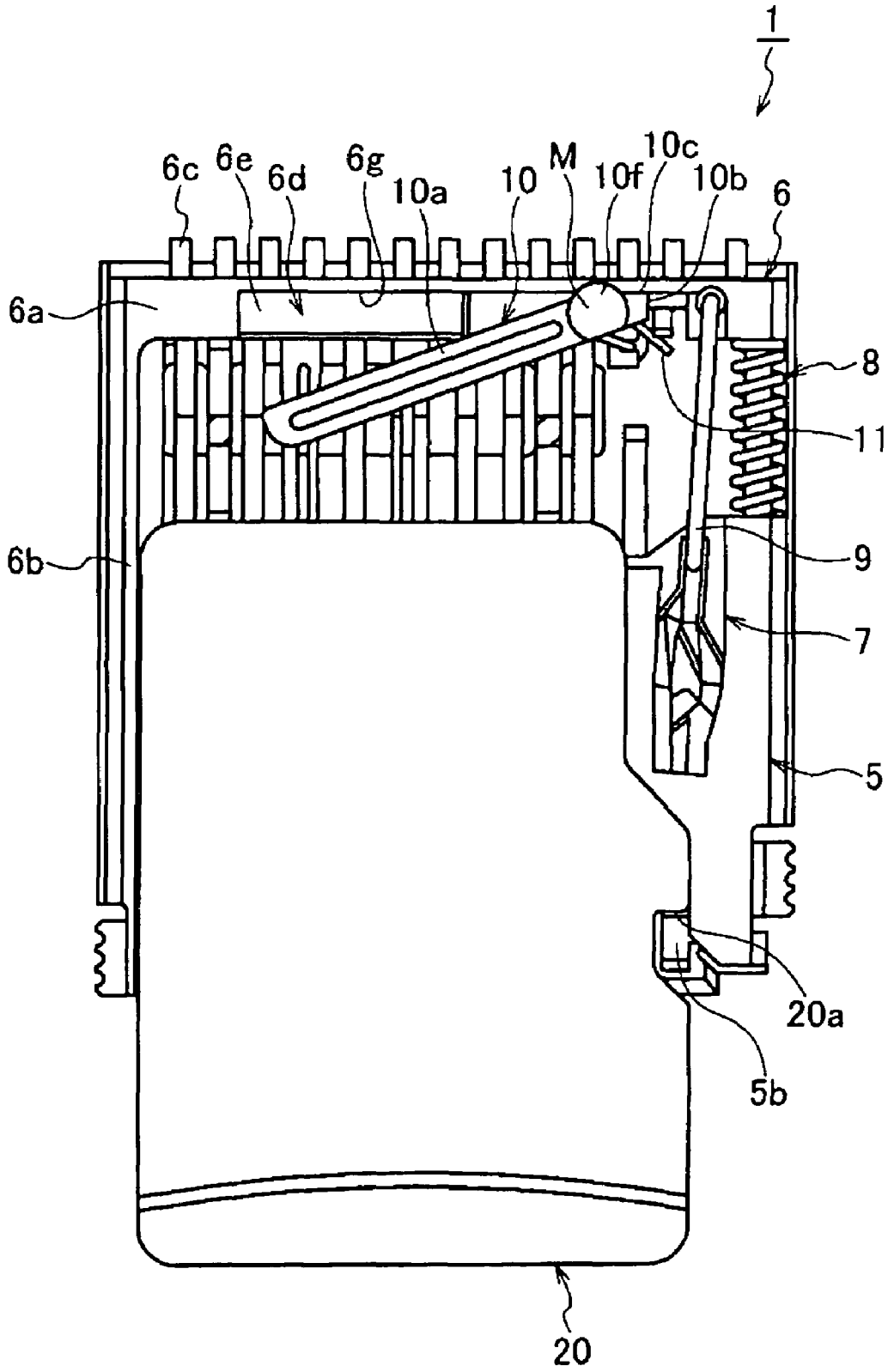
FIG. 4 provides a top view of the memory card socket structure from which a cover shell is detached, showing a state before a memory card is mounted in the socket structure.
Figure 5:
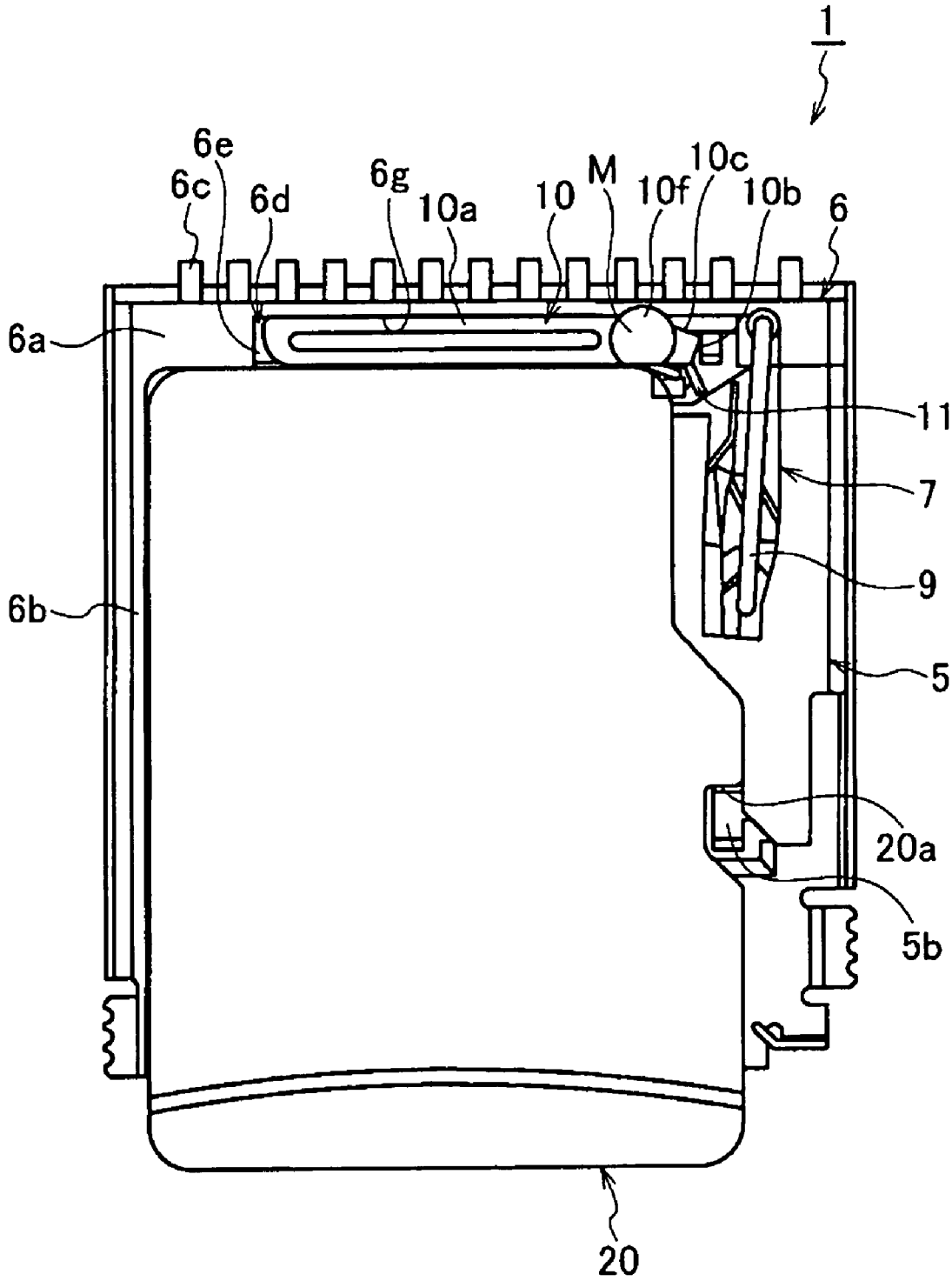
FIG. 5 depicts a top view of the memory card socket structure from which the cover shell s detached, showing a state where a memory card is mounted in the socket structure.

Also, a bar-shaped movable arm 10 is rotatably installed at the inner wall 6*a*. The movable arm 10 (specifically, a main arm portion 10*a* of the movable arm 10) is rotatingly biased toward the opening 1*b* side by a torsion spring 11 wounded around a protrusion 6*f* of the movable arm 10 as will be described later, while it is rotatingly pressed toward the rear side of the card compartment 1*a* through a leading end portion of the memory card 20. Accordingly, when the memory card 20 is yet to be inserted all the way to its mounted position near the rear side of the card compartment 1*a* and is in a non-engaging relationship with the movable arm 10, the movable arm 10 is fully rotated toward the opening 1*b* (below, simply referred to as an 'maximum opening 1*b*-side position'), as shown in FIG. 4. Further, as shown in FIG. 5, when the memory card 20 is inserted all the way to its mounted position, the movable arm 10 is rotated toward the rear side to be located at a rear position of the of the card compartment 1*a*. That is, the movable arm 10 is rotated between the maximum opening 1*b*-side position shown in FIG. 4 and the rear position shown in FIG. 5. Further, due to the characteristic of the heart cam mechanism, the movable arm 10 and the slider 5 are returned to a position which is spaced apart from the innermost side of the card compartment 1*a* and slightly towards the side of the opening 1*b* when the memory card 20 is completely mounted in the card compartment 1*a*.

Figure 6:
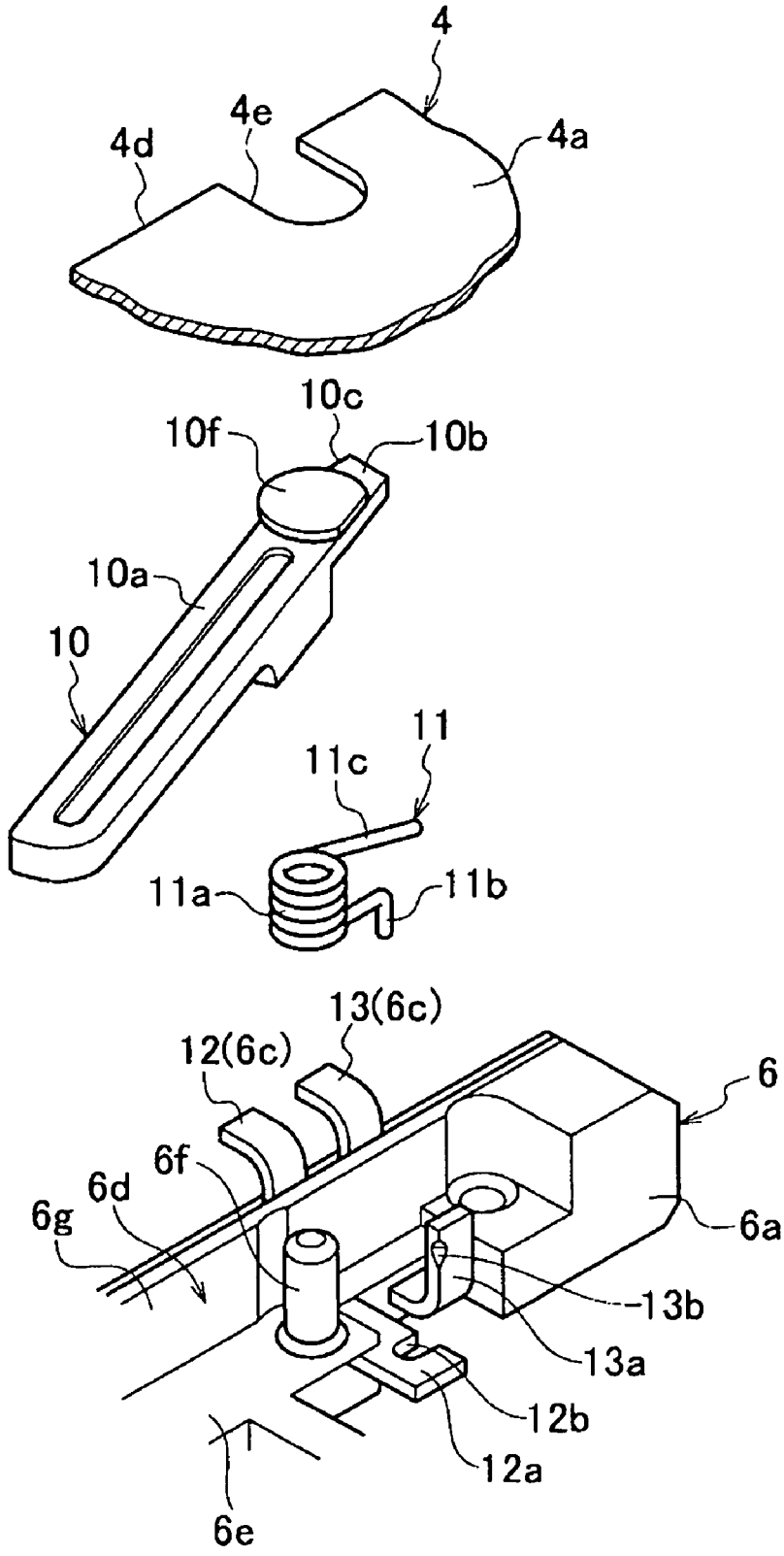
FIG. 6 offers an exploded perspective view of a memory card detecting mechanism incorporated in the memory card socket structure.
Figure 7A:
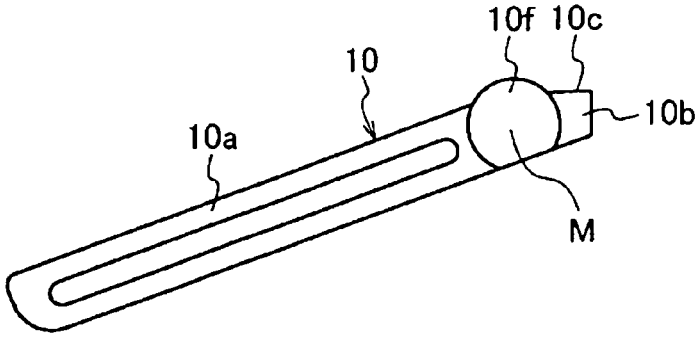
Figure 7B:
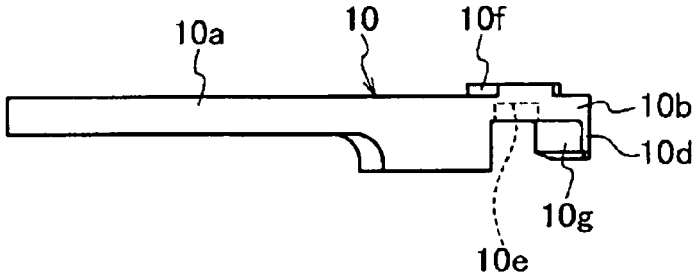
Figure 7C:
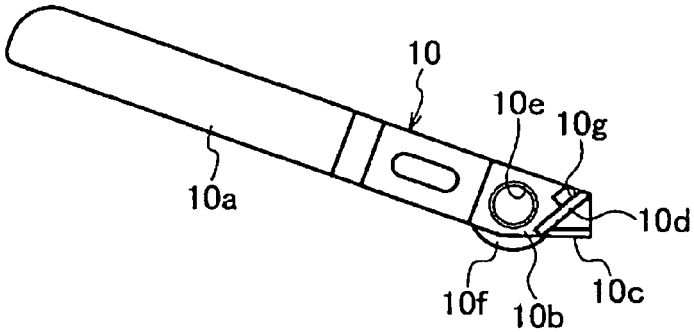
Figure 7D:
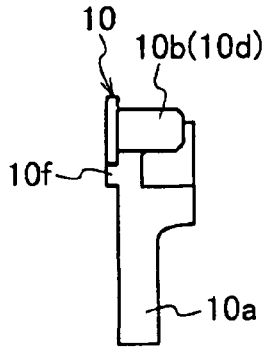
Figure 11:
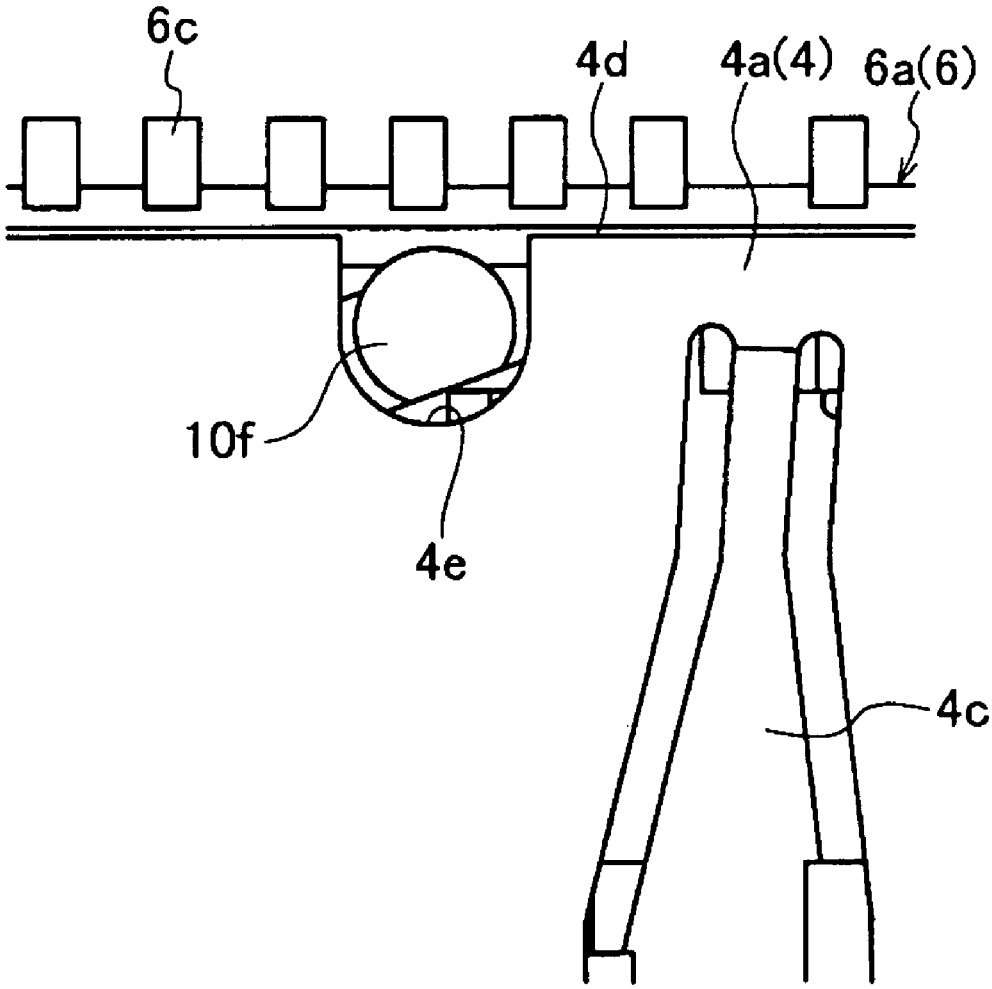
FIG. 11 sets forth a top view of a portion of the cover shell incorporated in the memory card socket structure where the memory card detecting mechanism is to be installed.

Both ends of a rotation shaft M of the movable arm 10 are axially supported at fixed components of the memory card socket structure 1 (e.g., the case 2 and the contact block 6). That is, as illustrated in FIG. 6, the substantially columnar protrusion 6*f* is protrudingly formed on a bottom surface 6*e* of a recess portion 6*d* of the inner wall 6*a*, and a leading end portion of the protrusion 6*f* is inserted into a recess portion 10*e* (see FIGS. 7B and 7C) formed at the movable arm 10. Further, a substantially columnar protrusion 10*f* is also formed at the recess portion 10*e*'s other side which is opposite to where the protrusion 6*f* is inserted, and the protrusion 10*f* is loosely placed inside an approximately U-shaped cutoff portion 4*e* formed at a rear edge 4*d* of the cover shell 4. Also, as shown in FIG. 11, the opened side of the cutoff portion 4*e* is closed by the inner wall 6*a* of the contact block 6, so that the movable arm 10 as well as the protrusion 10*f* are prevented from being dislodged from the cutoff portion 4*e* through its opened side.

Furthermore, the movable arm 10 has the main arm portion 10*a* to make contact with the memory card 20 and a sub arm portion 10*b* formed on an opposite side of the main arm portion 10*a* with respect to the rotation shaft M. The sub arm portion 10*b* has an engagement wall portion 10*d* on which one end portion 11*c* of the torsion spring 11 is to be engaged therewith.

The torsion spring 11 is wounded around the protrusion 6*f* of the contact block 6 such that one end portion 11*b* of a coiled portion 11*a*, which is proximal to the bottom surface 6*e*, is engaged with a recess portion 12*b* formed at a protruding portion 12*a* of a first stationary contact 12 (one contact terminal 6*c*) in the card compartment 1*a*, wherein the first stationary contact 12 is fixed at the inner wall 6*a*. Further, a torsion spring 11's other end portion 11*c* distal to the bottom surface 6*e* is engaged with the engagement wall portion 10*d* formed at the sub arm portion 10*b*. Because one end portion 11*b* of the torsion spring 11 is fixed, the engagement wall portion 10*d* can be pressed against the sub arm portion 10*b* in a rotation direction in which the sub arm portion 10*b* at the rear side of the card compartment 1*a* is pushed (i.e., a counterclockwise rotation direction of FIG. 4 or FIG. 8A). Accordingly, the main arm portion 10*a* can be rotatingly biased by the torsion spring 11 in a direction for pressing the leading end of the memory card 20', i.e., in a direction toward the opening 1*b* side.

Further, the end portion 11*c* is extended to an outside of the sub arm portion 10*b* and is leaned against a notch 13*b* formed at a protruding portion 13*a* of a second stationary contact 13 (another contact terminal 6*c*) in the card compartment 1*a*.

The torsion spring 11 is formed of a conductive wiring material such as an iron-based material. Thus, if both end portions 11*b* and 11*c* of the torsion spring 11 are brought into contact with the first and the second stationary contacts 12 and 13, respectively, the two stationary contacts 12 and 13 are made to be electrically connected to each other via the torsion spring 11.

Figure 8A:
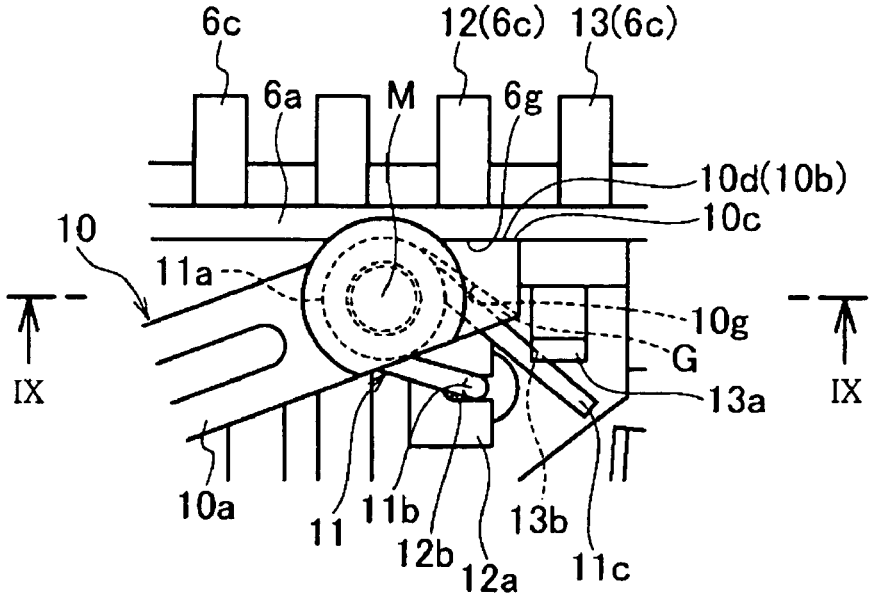

Here, as shown in FIG. 8A, when the main arm portion 10*a* of the movable arm 10 is located at the maximum opening 1*b*-side position (i.e., when the main arm portion 10*a* is rotated to a maximum extent in a counterclockwise rotation direction in FIG. 8A), there is formed an angled gap G between a contact surface 10*g* of the engagement wall portion 10*d* and the end portion 11*c* of the torsion spring 11, in a state of which the biasing force from the end portion 11*c* of the torsion spring 11 is not applied to the sub arm portion 10*b*.

The angled gap G can be obtained by cutting a part of the sub arm portion 10*b* on the side of the inner wall 6*a*, thereby forming an inclined surface 10*c* which comes into contact with a wall surface 6*g* of the inner wall 6*a*. It will be easily understood that when viewed from the top the angled gap G is controlled by adjusting the angle formed by the contact surface 10*g* and the wall surface 6*g* in a state of which the wall surface 6*g* and the inclined surface 10*c* are in contact with each other (that is, the state shown in FIG. 8A), while appropriately varying the arrangement of the protruding portion 13*a* of the second stationary contact 13 and the notch 13*b*. Furthermore, in this preferred embodiment, the inclined surface 10*c* serves as an abutting portion which is to be in contact with the contact block 6.

Figure 8B:
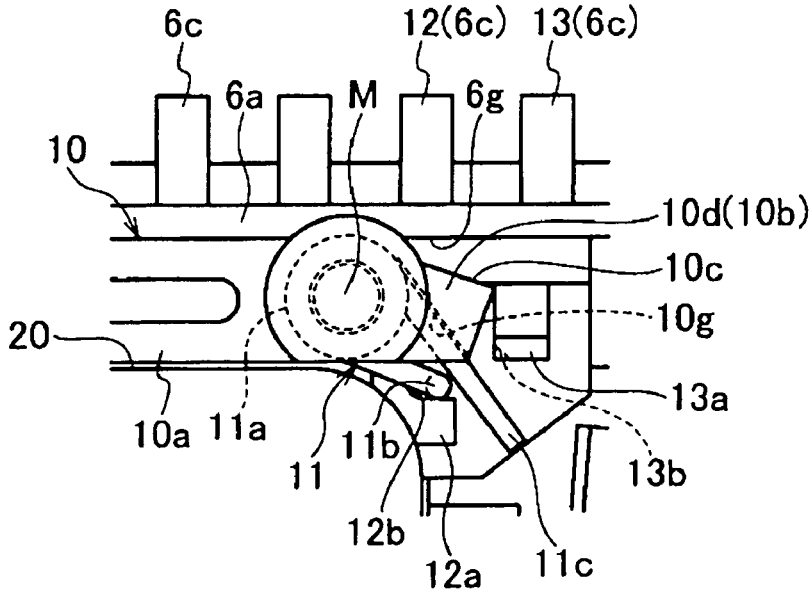

Meanwhile, as shown in FIG. 8B, if the movable arm 10 is rotated toward the rear side of the card compartment 1*a* by the memory card 20, the sub arm portion 10*b* is pivoted in a clockwise direction as viewed from FIG. 8B, and the end portion 11*c* of the torsion spring 11 is also allowed to rotate in the clockwise direction because it is engaged with the engagement wall portion 10*d*. As a result, the end portion 11*c* gets placed spaced from the second stationary contact 13, whereby the first stationary contact 12 and the second stationary contact 13 are electrically separated from each other.

In accordance with the above configuration, by using the torsion spring 11 as a movable contact point, the state of which the memory card 20 is inserted at the rear side of the card compartment 1*a* can be determined by detecting a non-conducting state of the first and the second stationary contact 12 and 13, whereas the state where the memory card 20 is not inserted at the rear side of the card compartment 1*a* in place is determined by detecting a conducting state of the first and the second stationary contact 12 and 13. Thus, by forming a detection circuit by way of connecting an anode side and a cathode side of a power source such as a battery to the first and the second stationary contact, the insertion state of the memory card 20 in the card compartment 1*a* can be detected based on a conducting or a non-conducting state of the detection circuit.

Figure 9:
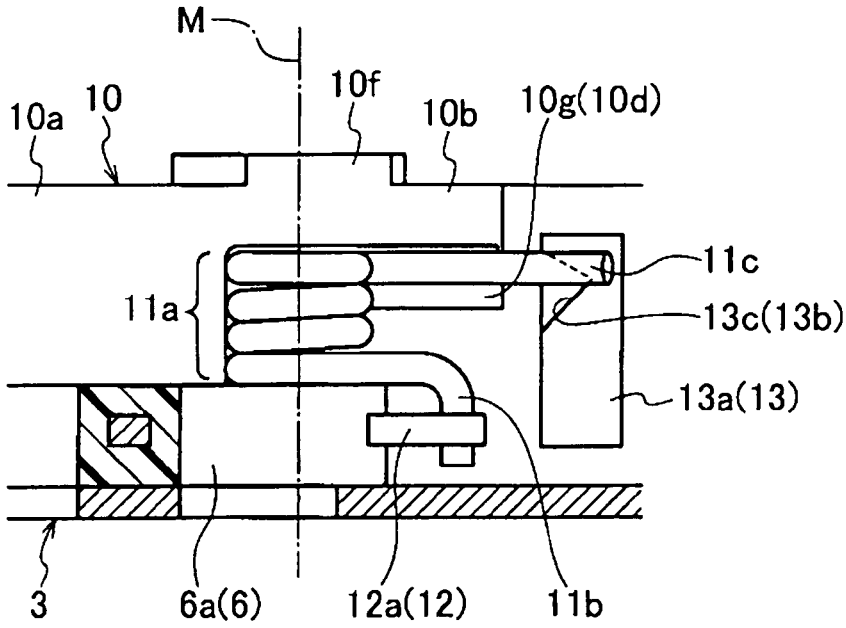
FIG. 9 is a side view of major components of the memory card detecting mechanism taken along a line IX-IX of FIG. 8A.
Figure 10:
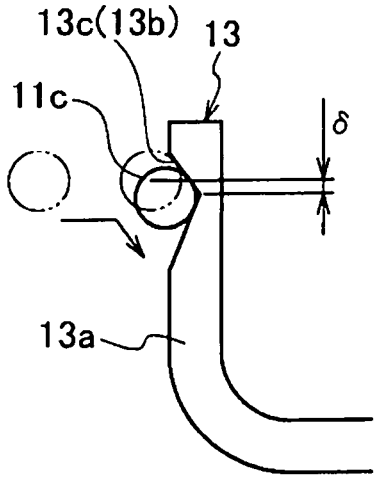
FIG. 10 illustrates a contact state between a torsion spring of the memory card detecting mechanism incorporated in the memory card socket structure and a second stationary contact.

Moreover, in this preferred embodiment, as illustrated in FIGS. 9 and 10, a core portion of the notch 13*b* and the end portion 11*c* of the torsion spring 11 are deviated by a distance δ in a longitudinal direction of the rotation shaft M, i.e., in a thickness direction of the card compartment 1*a*. Also, the notch 13*b* is formed with a sloped surface 13*c* for allowing the end portion 11*c* of the torsion spring 11 to slide thereon toward the core portion of the notch 13*b*. Specifically, if the memory card 20 is retreated from the rear side of the card compartment 1*a*, the movable arm 10 is rotated, and the end portion 11*c* once rested apart from the protruding portion 13*a* according to the angled gap G is brought into contact with the protruding portion 13*a*. Here, the end portion 11*c* is blocked by the sloped surface 13*c* of the notch 13*b* and is allowed to slide on the sloped surface 13*c* while contacting it.

Also, in this preferred embodiment, the core portion of the notch 13*b* is placed at a height set lower than that of the end portion 11*c* of the torsion spring 11 measured from a base portion of the protrusion 6*f*. Accordingly, while the end portion 11*c* is engaged with the notch 13*b*, the torsion spring 11 is subject to a force acting toward the base portion of the protrusion 6*f*.

In accordance with the preferred embodiment described above, by using the torsion spring 11, a greater biasing force can be applied to the memory card 20 and also to the movable arm 10, while the space occupied thereby is kept relatively small.

Further, since the movable arm 10 is disposed at the rear side of the card compartment 1*a* such that the main arm portion 10*a* is rotated between the maximum opening 1*b*-side position and the mounted position depending on the insertion and the extraction of the memory card 20, it is easy to apply a greater force to the movable arm 10 than a force sufficient to overcome a force required for a depth-directional (the insertion and extraction directions of the memory card 20) dimensional tolerance, the depth-directional dimensional tolerance being smaller than a width-wise dimensional tolerance of the memory card 20. From this, the movable arm 10 can be applied to a memory card socket structure for smaller memory cards with ease.

Moreover, the torsion spring 11, used for providing the biasing force to the movable arm 10 and also used as the movable contact, is configured to engage with the sub arm portion 10*b*. Therefore, the main arm portion 10*a* can be freed from having a function of receiving the torsion spring 11 or from being used as a supporting portion of the movable contact point. As a result, increase in size and complication for structures relating to the main arm portion 10*a*, the movable arm 10 and the neighboring components thereof can be prevented.

Also, in accordance with the preferred embodiment of the present invention, when the main arm portion 10*a* is rotated to the maximum opening 1*b*-side position (as shown in FIG. 8A), there is formed the angled gap G between the end portion 11*c* and the contact surface 10*g* of the sub arm portion 10*b*, so that the torsion spring 11 is not engaged with the sub arm portion 10*b*. At the same time, it is configured in such a manner that the torsion spring 11 is mounted by the first and the second stationary contact 12 and 13. Thus, it is possible to easily install the movable arm 10 in a condition where the pressing force from the torsion spring 11 is not applied thereto.

Moreover, in accordance with the preferred embodiment of the present invention, by configuring the inclined surface 10*c* of the sub arm portion 10*b* to be contacted with the wall surface 6*g* of the contact block 6, the positioning of the movable arm 10 can be facilitated for installation.

Further, in accordance with the preferred embodiment of the present invention, by supporting the movable arm 10 through both ends of the rotation shaft M thereof, the movable arm 10 can maintain its engagement in a more certain manner, thus enabling an exact movement thereof.

Furthermore, in accordance with the preferred embodiment of the present invention, by forming the notch 13*b* at the second stationary contact 13, the end portion 11*c* of the torsion spring 11 can be more securely connected to the second stationary contact 13, so that the torsion spring 11 and the movable arm 10 can be prevented from dislodging from the leading edge of the protrusion 6*f*.

Also, in accordance with the preferred embodiment of the present invention, by using the end portion 11*c* which is to be connected with or disconnected from the second stationary contact 13, dusts and debris or contaminants stuck to the notch 13*b* can be removed, thereby improving a contact reliability.

Also, in accordance with the preferred embodiment of the present invention, the core portion of the notch 13*b* is placed at a height set lower than that of the end portion 11*c* of the torsion spring 11 measured from a base portion of the protrusion 6*f*. Accordingly, while the end portion 11*c* is engaged with the notch 13*b*, the torsion spring 11 is subject to a: force acting toward the base portion of the protrusion 6*f*. Thus, the torsion spring 11 and the movable arm 10 can be: prevented from falling off the leading end side of the protrusion 6*f* in a surer manner.

Here, it is to be noted that the present invention is not limited to the preferred embodiment as described above and can be modified in various other ways.

For example, in the above configuration in accordance with the preferred embodiment of the present invention, though the movable arm is directly pushed back by the memory card, it is also possible to rotate the movable arm indirectly via, e.g., a slider depending on the insertion and extraction of the memory card.

Also, it is possible to configure the slider to contact with or support a wider area of the memory card, and the configuration and the arrangement of the slider and those of the groove portion, the pin, the spring, and etc. for positioning the memory card in the card accommodating portion can be appropriately modified.

While the invention has been shown and described with respect to the preferred embodiments, it will be understood by those skilled in the art that various changes and modifications may be made without departing from the spirit of the invention as defined in the following claims.

What is claimed is:

1. A memory card socket structure comprising:

a case having a card accommodating portion for receiving a thin plate-shaped memory card;

a contact block having contact terminals for the connection with electrodes of the memory card; and a movable arm rotatably installed at the contact block and moved in combination with an insertion and an extraction of the memory card into and from the card accommodating portion, wherein the memory card socket structure has a memory card detecting function for detecting whether the memory card is inserted into the card accommodating portion by way of switching an opening/closing of a circuit depending on the movement of the movable arm, wherein the movable arm includes a main arm portion to be in contact with a rear side of the memory card and a sub arm portion disposed opposite to the main arm portion with respect to a rotation shaft disposed at a rear portion of the card accommodation portion, and the movable arm is supported at an inner wall of the contact block such that an end portion of the main arm portion is moved in a direction of the insertion and the extraction of the memory card into and from the card accommodating portion between a position where the movable arm is fully rotated toward an entrance side of the card accommodating portion and an mounted position near the rear side of the card accommodating portion, wherein the rotation shaft of the movable arm is engaged with a torsion spring formed of a conductive material, and when a first end portion of the torsion spring is engaged with a first stationary contact provided at the contact block and a second end portion thereof is engaged with the sub arm portion, the main arm portion of the movable arm is rotatingly biased by the torsion spring toward the entrance side, and wherein as the second end portion of the torsion spring is rotated along with the sub arm portion to be connected or disconnected with a second stationary contact provided at the contact block, the opening/closing of the circuit including the first stationary contact, the torsion spring and the second stationary contact is switched.

2. The socket structure of claim 1, wherein the second end portion of the torsion spring is engaged with the second stationary contact when the main arm portion is in a position where the movable arm is fully rotated while being in a non-engaging relationship with the sub arm portion, and as the main arm portion is moved toward an innermost position, the second end portion of the torsion spring engaged with and biased by the sub arm portion is configured to be distant from the second stationary contact.

3. The socket structure of claim 2, wherein the sub arm portion has a contact portion to be brought into contact with the contact block when the main arm portion is in the position where the movable arm is fully rotated.

4. The socket structure of claim 2, wherein the case has plate-shaped members disposed to enclose a front surface and a rear surface of the memory card, and the movable arm is rotatably supported at the contact block or one of the plate-shaped members.

5. The socket structure of claim 2, wherein the second stationary contact has a notch to be engaged with the second end portion of the torsion spring.

6. The socket structure of claim 5, wherein a core portion of the notch and the second end portion of the torsion spring are deviated in a longitudinal direction of the rotation shaft of the movable arm, and the notch is provided with a slope surface for guiding the second end portion of the torsion spring toward the core portion of the notch when the memory card is extracted from the card accommodation portion.

7. The socket structure of claim 6, wherein the core portion of the notch is lower than the second end portion of the torsion spring.

8. A memory card socket structure comprising:

a case having a card accommodating portion for receiving a thin plate-shaped memory card;

a contact block having contact terminals for the connection with electrodes of the memory card; and a movable arm rotatably installed at the contact block and moved in combination with an insertion and an extraction of the memory card into and from the card accommodating portion, wherein the memory card socket structure has a memory card detecting function for detecting whether the memory card is inserted into the card accommodating portion by way of switching an opening/closing of a circuit depending on the movement of the movable arm, wherein the movable arm includes a main arm portion to be in contact with the memory card and a sub arm portion disposed opposite to the main arm portion with respect to a rotation shaft, and the movable arm is supported at an inner wall of the contact block such that the main arm portion is rotated between a position where the movable arm is fully rotated toward an entrance side of the card accommodating portion and an mounted position near a rear side of the card accommodating portion, wherein the rotation shaft of the movable arm is engaged with a torsion spring formed of a conductive material, and when a first end portion of the torsion spring is engaged with a first stationary contact provided at the contact block and a second end portion thereof is engaged with the sub arm portion, the main arm portion of the movable arm is rotatingly biased by the torsion spring toward the entrance side, wherein as the second end portion of the torsion spring is rotated along with the sub arm portion to be connected or disconnected with a second stationary contact provided at the contact block, the opening/closing of the circuit including the first stationary contact, the torsion spring and the second stationary contact is switched, wherein the second end portion of the torsion spring is engaged with the second stationary contact when the main arm portion is in a position where the movable arm is fully rotated while being in a non-engaging relationship with the sub arm portion, and as the main arm portion is moved toward an innermost position, the second end portion of the torsion spring engaged with and biased by the sub arm portion is configured to be distant from the second stationary contact, wherein the second stationary contact has a notch to be engaged with the second end portion of the torsion spring, and wherein a core portion of the notch and the second end portion of the torsion spring are deviated in a longitudinal direction of the rotation shaft of the movable arm, and the notch is provided with a slope surface for guiding the second end portion of the torsion spring toward the core portion of the notch when the memory card is extracted from the card accommodation portion.

9. The socket structure of claim 8, wherein the core portion of the notch is lower than the second end portion of the torsion spring.

* * * * *